United States Patent [19]

Schweiger et al.

[11] Patent Number: 4,539,539

[45] Date of Patent: Sep. 3, 1985

[54] ELECTROMAGNETIC RELAY AND METHOD FOR ADJUSTING THE ARMATURE THEREOF

[75] Inventors: Josef Schweiger; Bernhard Hering, both of Munich, Fed. Rep. of Germany

[73] Assignee: Siemens Aktiengesellschaft, Berlin & Munich, Fed. Rep. of Germany

[21] Appl. No.: 535,036

[22] Filed: Sep. 23, 1983

[30] Foreign Application Priority Data

Oct. 29, 1982 [DE] Fed. Rep. of Germany ..... 3240184

[51] Int. Cl.[3] ..... H01H 51/22

[52] U.S. Cl. ..... 335/78; 335/86; 29/622

[58] Field of Search ..... 335/78, 80, 81, 86, 335/275, 274, 273, 82, 79, 83; 29/622

[56] References Cited

U.S. PATENT DOCUMENTS

| | | | |
|---|---|---|---|
| 3,043,932 | 7/1962 | Morris | 335/81 |
| 3,522,564 | 8/1970 | Mori et al. | 335/153 |
| 4,075,585 | 2/1978 | Sauer | 335/78 |
| 4,195,276 | 3/1980 | Rauterberg | 335/151 |
| 4,311,976 | 1/1982 | Sauer et al. | 335/78 |

FOREIGN PATENT DOCUMENTS 2918100 11/1980 Fed. Rep. of Germany .

*Primary Examiner*—E. A. Goldberg
*Assistant Examiner*—George Andrews
*Attorney, Agent, or Firm*—Hill, Van Santen, Steadman & Simpson

[57] ABSTRACT

An electromagnetic relay has a tongue armature disposed inside a hollow coil body and having a free end movable between two cooperating pole plates, and a fixed end having an additional spring section disposed at an angle with respect to the movable portion of the armature, the spring section being secured to one of the coil flanges, thereby extending the effective free spring length of the armature so as to improve the sensitivity of the relay. The position of the armature with respect to the pole plates is adjustable after encapsulation of the relay by irradiating the spring section of the armature with thermal pulses, such as laser pulses at specified locations.

5 Claims, 3 Drawing Figures

ELECTROMAGNETIC RELAY AND METHOD FOR ADJUSTING THE ARMATURE THEREOF

BACKGROUND OF THE INVENTION

1. Field of the Invention

The present invention relates to an electromagnetic relay and a method for adjusting the armature of such a relay during manufacture, and in particular to an electromagnetic relay having a spring armature with a free end movable with respect to at least one cooperating pole plate and fixed end secured to the coil body at a coil flange thereof.

2. Description of the Prior Art

An electromagnetic relay having a tongue armature with a free end movable with respect to at least one pole plate and having a fixed end connected to a coil flange of the coil body is described in German AS No. 27 01 230. The resilient armature in that relay is connected to a carrier at the mounted end thereof, the carrier forming an adjustment plate which can be permanently deformed by means of an externally applied magnetic field in order to adjust the position of the armature. Such adjustment can be undertaken after the relay has been completely encapsulated after casting, however, the volume required for the adjustment plate must be incorporated in the design of the relay, which places a limit on miniaturization of the relay because the coil diameter cannot be made arbitrarily small. Moreover, the free spring length of the tongue armature in this conventional relay is limited by the interior volume of the coil body.

A relay having a spring-elastic tongue armature disposed inside the coil body is also known from German AS No. 19 09 940. The fastened end of the tongue armature of that relay is welded to a nose of a terminal pin. Adjustment of this relay is possible only by mechanically bending the armature at the location of the nose by means of an externally applied tool. The free spring length is also limited by the length of the hollow interior of the coil body.

The general concept of adjusting the position of a relay armature by irradiating the armature with thermal pulses is disclosed in German OS No. 29 18 100.

SUMMARY OF THE INVENTION

It is an object of the present invention to provide an electromagnetic relay having a tongue armature with a free end movable with respect to at least one pole plate and a fixed end, wherein the free spring length of the armature is not limited to the length of the interior of the coil body through which the armature extends, thereby giving the armature a "soft" spring characteristic yet maintaining a sufficiently large cross-section for magnetic flux guidance and permitting utilization of a short coil body for miniaturization of the overall relay design.

The above objects are inventively achieved in an electromagnetic relay wherein the armature has an additional spring section secured to the mounting means for the armature, and which is disposed at a substantially right angle relative to the coil axis and which is utilized to mount the armature frontally to one of the coil flanges. The armature is secured to the end face of the coil flange only by means of this additional spring section.

The tongue armature in the relay constructed in accordance with the principles of the present invention exhibits "softer" spring characteristics than armatures in conventional relays having the same cross-section and the same coil length. This is due to the additional spring section disposed in front of the coil flange extending substantially perpendicularly to the coil axis so that lower forces from a permanent magnet or an excitation coil are sufficient to effect switching of the relay. The relay disclosed herein is thus more sensitive than conventional relays. A further advantage of the structure of the relay disclosed and claimed herein is that the additional spring section is also accessible for adjusting the position of the relay by irradiation of that section with thermal pulses, such as laser pulses. The relay can thus be non-mechanically adjusted without the need for contact with an adjustment tool.

In a preferred embodiment of the relay, the additional spring section of the armature is disposed in a recess in one of the flanges of the coil body. The armature in this embodiment may additionally have a fastening tab connected to the angled spring section, the fastening tab similarly being frontally disposed at one of the coil flanges but which, in contrast to the additional spring section, rests against the coil flange. Fastening of the armature spring can be undertaken by means of deformable fastening lugs extending from the coil body through the additional spring section and, if necessary, through the fastening tab.

In a further embodiment of the adjustment method for this relay, the additional spring section of armature may be irradiated with thermal pulses at specific points of a prescribed matrix or raster. Such adjustment is particularly efficient when undertaken with laser pulses.

DESCRIPTION OF THE PREFERRED EMBODIMENTS

Figure 1:
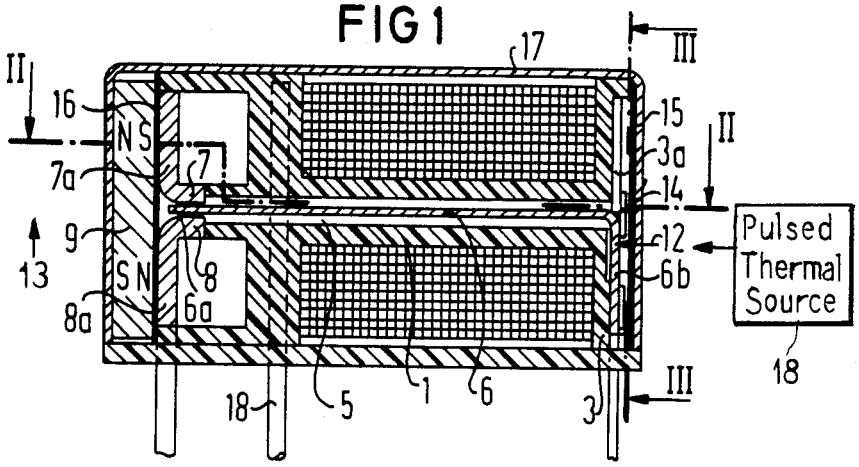
FIG. 1 is a side sectional view of an electromagnetic relay constructed in accordance with the principles of the present invention taken along line I—I of FIG. 2.
Figure 2:
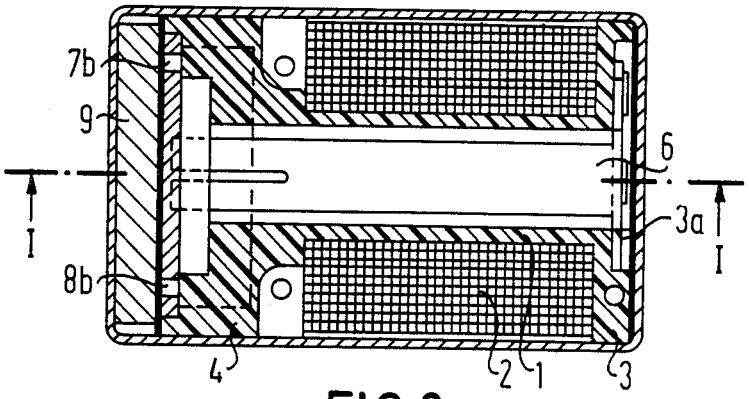
FIG. 2 is a plan sectional view of an electromagnetic relay constructed in accordance with the principles of the present invention taken along line II—II of FIG. 1.
Figure 3:
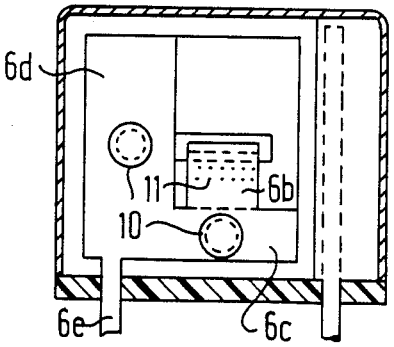
FIG. 3 is an end sectional view of an electromagnetic relay constructed in accordance with the principles of the present invention taken along line III—III of FIG. 1.

An electromagnetic relay constructed in accordance with the principles of the present invention is shown in various sectional views in FIGS. 1, 2 and 3. The relay has a coil body 1 with a winding 2 limited by coil flanges 3 and 4 at the opposite ends of the coil body 1. A spring-elastic tongue armature 6 is disposed in the hollow interior 5 of the coil body 1, and has a free end 6*a* movable between two cooperating pole plates 7 and 8. The cooperating pole plates 7 and 8 have respective angled sections 7*a* and 8*a* disposed in a common plane and forming a seating surface for a flat 4-pole permanent magnet 9. The relay has a longitudinal coil axis extending substantially through the center of the hollow interior 5.

The armature 6 has an angled additional spring section 6*b* at its end opposite the free end 6*a*. The spring section 6*b* is disposed at substantially a right angle to the coil axis and lies frontally along the coil flange 3 but is not in contact therewith. The spring section 6*b* thus extends the overall effective free spring length of the armature 6. The additional spring section **6*b* is connected to a fastening section 6*c* which rests against the coil flange 3 and is secured thereto with a deformable lug 10 extending from the coil body 1 through an opening in the fastening section 6*c*. A further fastening section 6*d* may be connected laterally to the spring section 6*b*, the further fastening section 6*d* similarly being secured to the coil flange 3 by means of a deformable lug 10. A terminal pin 6*e* is also connected to the fastening section 6*c* (or the additional fastening section 6*d*) which provides an electrical contact means for the tongue armature and simultaneously serves as the center contact spring. In order to guarantee free mobility of the additional spring section 6*b* when switching the armature 6, the coil flange 3 exhibits a recess 3*a* in which the spring section 6*b*** is disposed.

For purposes of adjustment, the additional spring section **6*b* of the armature 6 is irradiated with thermal pulses, such as laser pulses, from a pulsed thermal source 18. The pulses are directed to strike the armature 6 at points 11 which are points of a raster or matrix and effect a permanent deformation of the spring section 6*b* and in turn thereby position the armature 6. If the spring section 6*b* is irradiated in the direction of the arrow 12 as shown in FIG. 1, the free end 6*a* of the armature 6 is displaced in the direction of the arrow 13. If the free end 6*a* must be adjusted in the opposite direction, such adjustment could be undertaken by direct mechanical pressure on a point 14, or by means of mechanical pressure at the point 14 and simultaneous irradiation with laser pulses. It is preferable, however, to initially mount the armature 6 such that the free end 6*a* presses against the pole plate 8 so that the armature 6 can subsequently be adjusted solely by irradiation with thermal pulses without mechanical contact. As stated above, it is preferable to provide a point raster on the additional spring section 6*b*** to permit irradition of specific points of the raster depending upon the magnitude of the required deformation necessary to effect adjustment. Further details of a general method for adjusting the armature of a relay by the irradiation of selected points of a matrix are disclosed in the co-pending application, also assigned to Siemens AG, of Erwin Steiger and Dr. Bernhard Hering entitled "Method and Apparatus for the Adjustment of Contact Springs in a Relay" U.S. Ser. No. 535,454 filed Sept. 23, 1983 corresponding to German Patent Application No. P 32 35 714.1.

After adjustment, the recess **3*a* of the coil body may be provisionally covered by a film 15, and the opening of the coil body 1 at the opposite end may be provisionally sealed by means of a film 16 disposed between the pole plate section 7*a* and 8*a*, and the permanent magnet 9. After placement of the relay inside a ferromagnetic cap 17, the cavities can then be sealed with casting resin without the resin being able to penetrate to the interior 5 of the coil body 1**.

The general manner of operation of the relay corresponds to that disclosed in the aforementioned German AS No. 27 01 230. The ferromagnetic cap 17 functions as a flux guidance means for the permanent magnetic circuit as well as for the excitation circuit. The cooperating pole plates 7 and 8 are provided with terminal pins **7*b* and 8*b* in a standard format. Coil connection pins 18 are also embedded in the coil body 1** in a known manner.

Although modifications and changes may be suggested by those skilled in the art it is the intention of the inventors to embody within the patent warranted hereon all changes and modifications as reasonably and properly come within the scope of their contribution to the art.

We claim as our invention:

1. An electromagnetic relay comprising:

a hollow coil body having two end flanges and a central section therebetween about which a coil having a longitudinal coil axis is wound;

at least one pole piece disposed at one of said flanges;

a tongue armature extending through said coil body substantially along said longitudinal coil axis having a free end movable relative to said pole piece and having an additional spring section extending substantially perpendicular to said coil axis at the other of said end flange; and means connecting said additional spring section to said other of said end flanges incuding a first fastening tab extending from said additional spring section, said first fastening tab having a bore therein, and including a deformable lug extending from said coil body through said bore in said first fastening tab.

2. A relay as claimed in claim 1 wherein said other of said end flanges has a recess and wherein said additional spring section of said armature is disposed in said recess.

3. A relay as claimed in claim 1 wherein said means connecting said additional spring section to said other of said end flanges further includes a second fastening tab extending from said additional spring section at an angle relative to said first fastening tab, said second fastening tab having a bore therein, and said connecting means further includes another deformable lug extending from said coil body through said bore in said second fastening tab.

4. A method for adjusting the position of a tongue armature in an electromagnetic relay relative to at least one pole piece in said relay, said tongue armature having a free end movable relative to said pole piece and a fixed end at which an additional spring section is disposed extending substantially perpendicular to a longitudinal coil axis of said relay, said method comprising the steps of:

defining a point matrix on said spring section of said tongue armature; and irradiating said spring section of said tongue armature at one or more specified points of said point matrix for effecting selected amounts of deformation of said spring section with thermal pulses.

5. A method for adjusting an electromagnetic relay as claimed in claim 4 further defined by irradiating said selected points with laser pulses.

* * * * *